US005934550A

United States Patent [19]

Morris et al.

[11] Patent Number: 5,934,550

[45] Date of Patent: Aug. 10, 1999

[54] CONTAINER WITH INTEGRAL POURING SPOUT

[76] Inventors: Kenneth E. Morris; Jennifer M. Morris, both of 312 Waterwheel Ct., Blue Springs, Mo. 64015

[21] Appl. No.: 08/899,021

[22] Filed: Jul. 23, 1997

[51] Int. Cl.[6] ..... B65D 5/74

[52] U.S. Cl. ..... 229/121; 229/122.2; 229/125.42; 229/155

[58] Field of Search ..... 229/121, 122.2, 229/125.42, 155, 248

[56] References Cited

U.S. PATENT DOCUMENTS

| | | |
|---|---|---|
| 3,892,347 | 7/1975 | Egleston . |
| 3,989,171 | 11/1976 | Arneson . |
| 4,054,240 | 10/1977 | LaPierre . |
| 4,142,635 | 3/1979 | Capo et al. . |
| 4,180,167 | 12/1979 | Leavitt et al. . |
| 4,421,236 | 12/1983 | Lowe . |
| 4,569,443 | 2/1986 | Roccaforte . |
| 4,684,058 | 8/1987 | Weber . |
| 4,887,718 | 12/1989 | Anderson et al. . |
| 4,921,104 | 5/1990 | Holmes . |
| 5,000,320 | 3/1991 | Kuchenbecker . |
| 5,169,059 | 12/1992 | Desmond et al. . |
| 5,259,552 | 11/1993 | Kuchenbecker . |
| 5,429,297 | 7/1995 | Walsh . |
| 5,437,406 | 8/1995 | Gordon et al. . |
| 5,494,216 | 2/1996 | Van Suntenmaartensdijk . |
| 5,531,376 | 7/1996 | Brink et al. . |

*Primary Examiner*—Gary E. Elkins
*Attorney, Agent, or Firm*—Chase & Yakimo, L.C.

[57] ABSTRACT

A cardboard blank includes a front wall, end wall, side walls, top wall and bottom wall and glue flaps for presenting a container upon folding. An opening is presented In the top wall of the container with a spout assembly, integral with the blank, surrounding the opening. The spout assembly is foldable between open and closed positions. The lower wall of the container presents first and second flaps maintained together by a tab insert. Removal of the tab presents a second opening for gross discharge of the container contents. A tab on the spout assembly is insertable in a slot on the top wall for maintaining the spout assembly in a closed position.

4 Claims, 6 Drawing Sheets

CONTAINER WITH INTEGRAL POURING SPOUT

BACKGROUND OF THE INVENTION

This invention relates to paper containers and, more particularly, to a container presented by a foldable blank having first and second outlets for dispensing the contents of the container with one of the outlets having a pouring spout assembly integral with the blank.

Various types of cardboard blanks which are foldable into container configurations are known. A pouring spout is preferred with such containers so as to regulate the dispensation of the contents from the container. However, the associated pouring spout has usually been a separate metal assembly apart from the blank and is thus not integral with the blank and/or an environmentally friendly feature. Moreover, the ability to quickly dispense the contents of the container from more than one outlet has not been addressed.

SUMMARY OF THE INVENTION

In response thereto we have provided a foldable cardboard blank having a plurality of foldable panels, wall flaps and adhesion tabs therein, the blank being easily foldable into a container configuration. The folded blank presents a releasable flap at the bottom of the container so as to quickly discard the entire contents of the container therefrom. Along the top wall of the container and about a top opening is a spout assembly integral with the blank, for regulating the discharge of the contents from the top opening. Our cardboard blank provides the user a container with the option of dispensing the contents of the container in gross from the lower opening or dispensation from the upper wall opening as regulated by the integral spout. The spout is easily moved between a first position for closing the upper opening and a second position for allowing dispensation of the contents therefrom. The use of the integral pouring spout precludes the need for using separate environmentally undesirable metal pour spouts in connection with the recyclable material of the container blank.

It is therefore a general object of this invention to provide a container made from a cardboard blank, the container having lower and upper discharge outlets.

A further object of this invention is to provide a container, as aforesaid, the upper discharge outlet being associated with an integral pouring spout.

A still further object of this invention is to provide a container, as aforesaid, the container having an integral pour spout which positively guides the dispensation of the contents from the associated outlet.

Still a further object of this invention is to provide a blank, as aforesaid, which is easily foldable into the container configuration.

Another object of this invention is to provide a blank, as aforesaid, the blank equipped with adhesion flaps for providing stability and rigidity to the resulting container.

Still another object of this invention is to provide a device, as aforesaid, which presents a pouring spout made from the same material as the blank.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
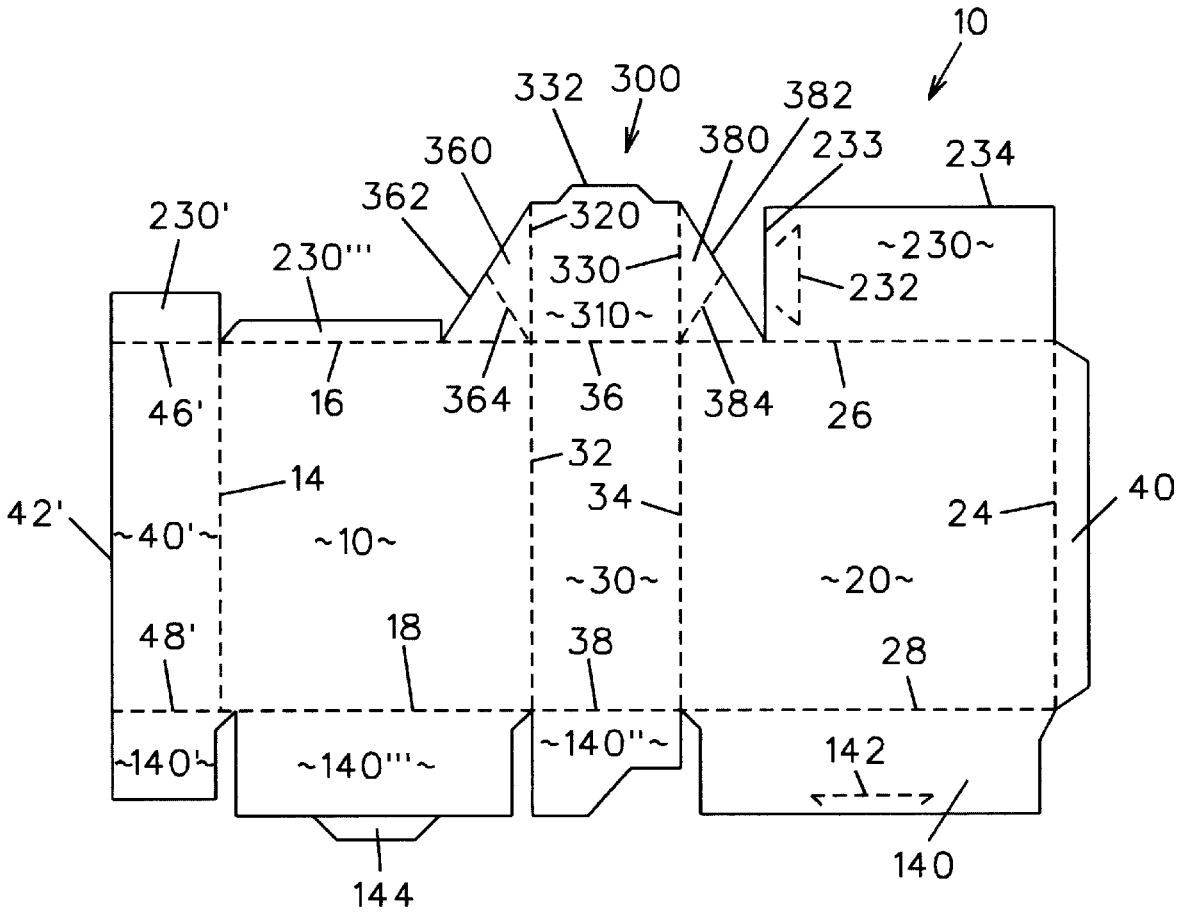
FIG. 1 is a plan view of a blank for the container.

Turning more particularly to the drawings, FIG. 1 illustrates a plan view of the cardboard blank 10, certain fold lines being shown therein. Blank 10 comprises a rectangular front panel 30 as defined by laterally spaced-apart vertical fold lines 32 and 34 and vertically spaced-apart upper 36 and lower 38 horizontal fold lines. Foldably connected to the fold line 34, right side as viewed, is a first rectangular side panel 20. The side panel 20 presents an upper horizontal fold line 26, a lower horizontal fold line 28 and a vertical fold line 24 laterally displaced from fold line 34. Extending from the fold line 24 is an end wall glue tab 40.

An opposed second side panel 10, left side as viewed, extends from the vertical fold line 32 and presents a lower horizontal fold line 18, an upper horizontal fold line 16 and a vertical fold line 14 laterally spaced from the fold line 32 of the front panel 30. Extending from the vertical fold line 14 is a generally rectangular end wall flap 40', the flap 40' presenting a free vertical edge 42'. The flap 40' also includes upper fold line 46' and lower fold line 48'. End wall flap 40' is designed to adhesively engage end wall flap 40 upon the blank being folded such that the adhesive on the end wall glue tab 40 contacts the end wall panel 40'.

Foldably connected to the fold line 48' is a bottom wall flap 140' generally rectangular in configuration. A top wall flap 230' is foldably connected to the fold line 46'.

Foldably connected to the lower fold line 28 of side panel 20 is a generally rectangular bottom wall flap 140, the flap 140 having a tab insert opening 142 therein. Extending from the lower fold line 38 of front panel 30 is a bottom wall flap 140" with a flap 140'" extending from the fold line 18 of side panel 10. Flap 140'" presents a tab 144 designed to extend into the tab insert 142 when the blank is in its folded container configuration.

Along a portion of the upper fold line 16 of front panel 10 is a top wall glue tab 230'", the glue tab 230'" laterally extending between the vertical fold line 14 and terminating short of the vertical fold line 32.

Foldably connected to upper fold line 26 is a top wall panel 230 having a tab insert 232 therein. Rectangular panel 230 laterally extends along fold line 26 and between vertical edge 24 and terminates in a vertical edge 233 laterally displaced from fold line 34.

Foldably connected to the upper fold line 36 of front panel 30 is the spout assembly 300 including a spout front wall panel 310 foldable along the upper fold line 36. Extending from the vertical fold lines 320, 330 of spout 300 are first and second triangular gussets 360, 380. Each gusset 360, 380 is formed by a free diagonal edge 362, 382 extending from the top of vertical fold lines 320, 330 and to the end of the glue tab 230'" and top wall panel 280. Within each gusset 360, 380 is a fold line 364, 384 normal to the diagonal edge 362, 382.

To shape the container the respective panels and flaps are folded about their respective fold lines. Upon such folding the bottom wall flap 142 is presented so as to receive the tab 144 within insert. Adjacent flaps 140' and 140" offer rigidity thereto.

Concurrently, top wall flap 230 lies atop the glue tab 230'" and flap 230'. Glue tab 230'" adhesive contacts one or both of these flaps so as to offer rigidity thereto.

Finally, end wall 40' will adhesively contact the glue tab 40 so as to adhere thereto.

Upon such folding the top wall flaps 230, 230' will adhere to the glue flap 230'". As flaps 230 and 230'" do not extend the full length of fold lines 16 and 26, an opening 500 will be presented adjacent fold line 36 of front wall 30.

Figure 2:
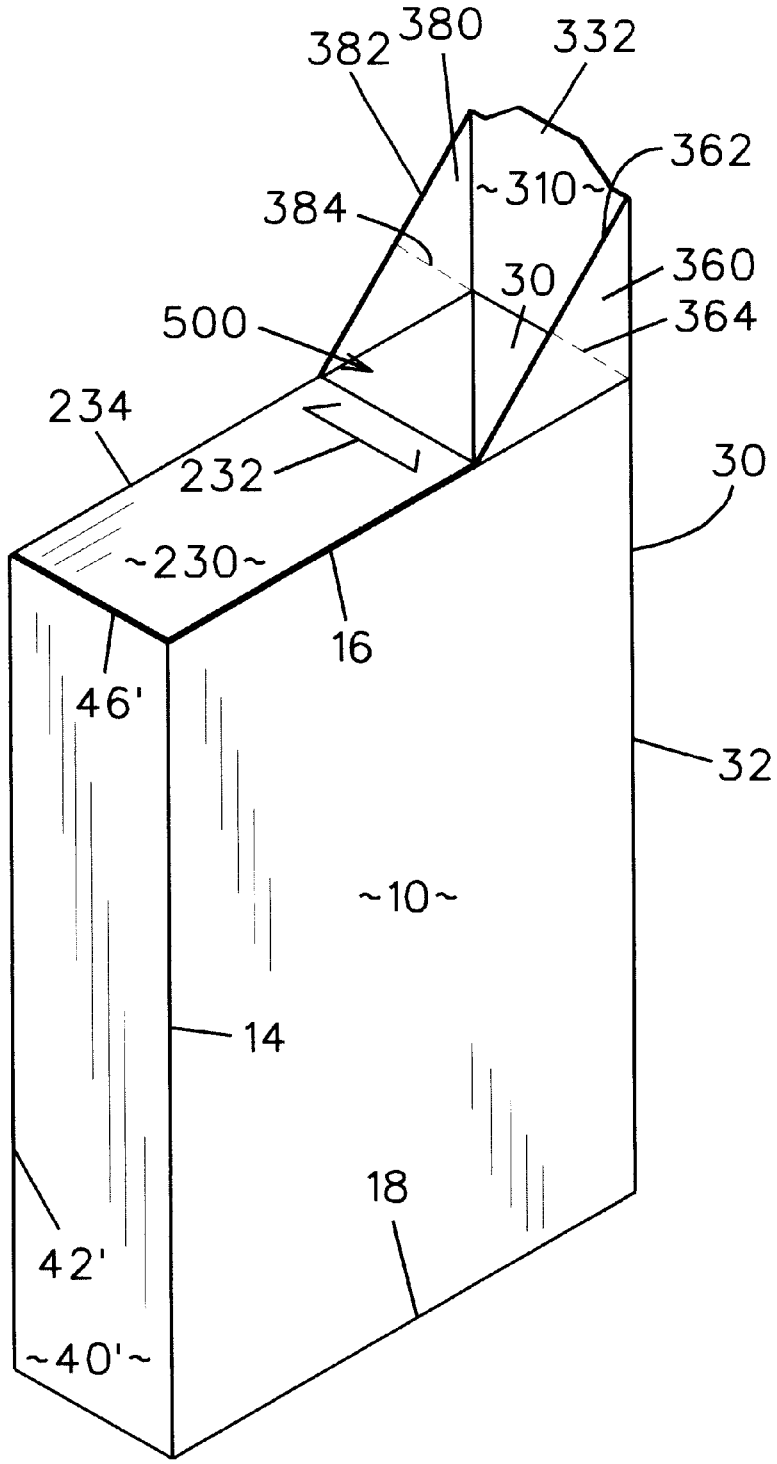
FIG. 2 is a perspective view of the blank of FIG. 1 as folded into the container configuration with the pour spout being in an open position.
Figure 3:
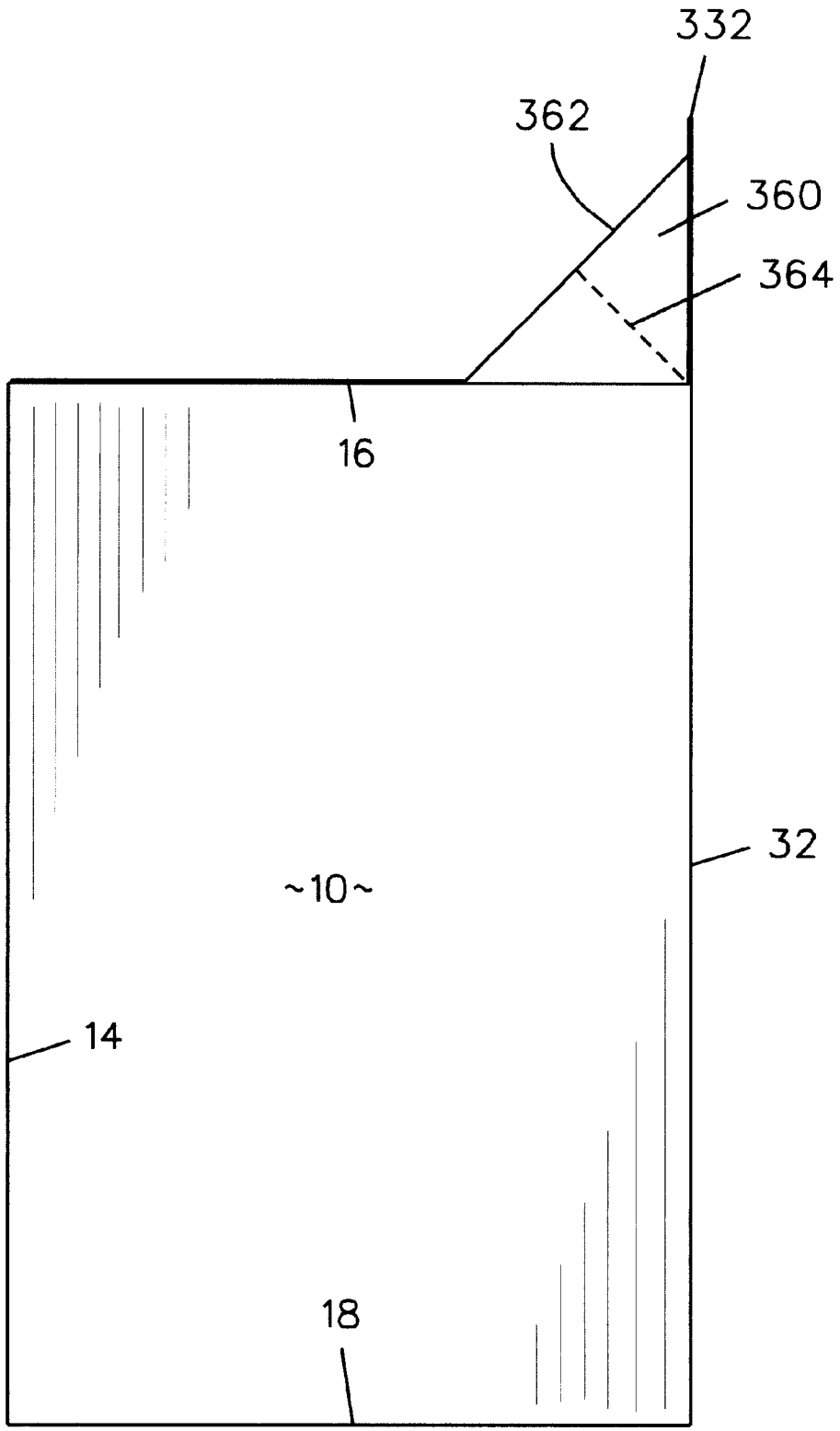
FIG. 3 is a side view of the FIG. 2 container.
Figure 4:
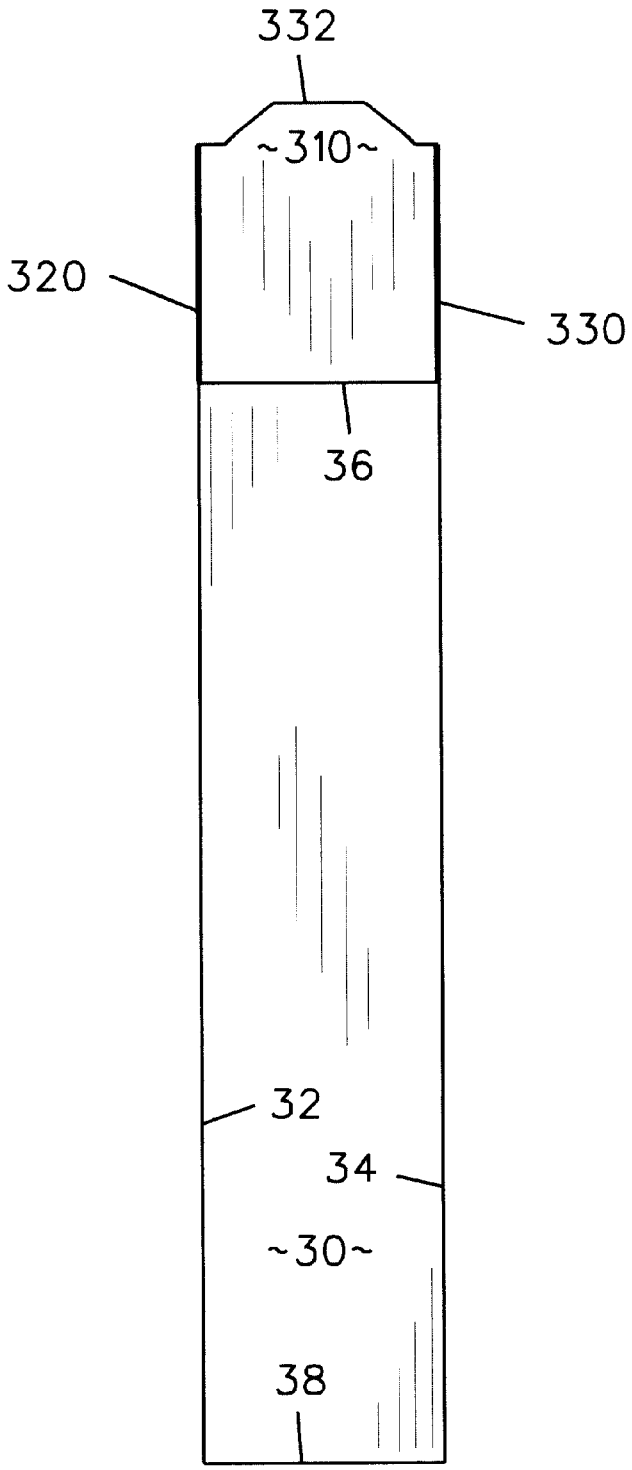
FIG. 4 is a front view of the FIG. 2 container.
Figure 5:
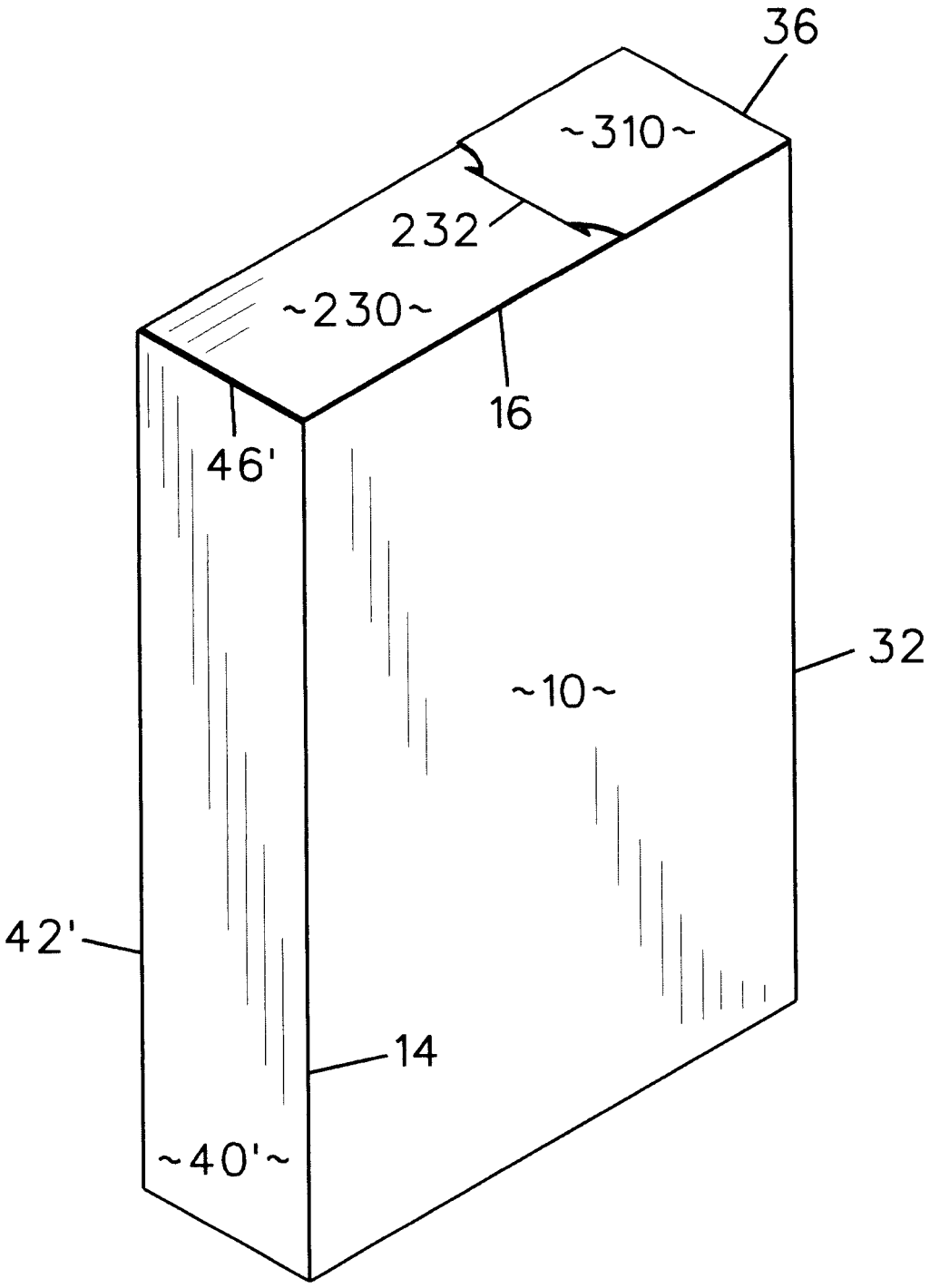
FIG. 5 is a perspective view of the FIG. 2 container with the pour spout in a closed position.
Figure 6:
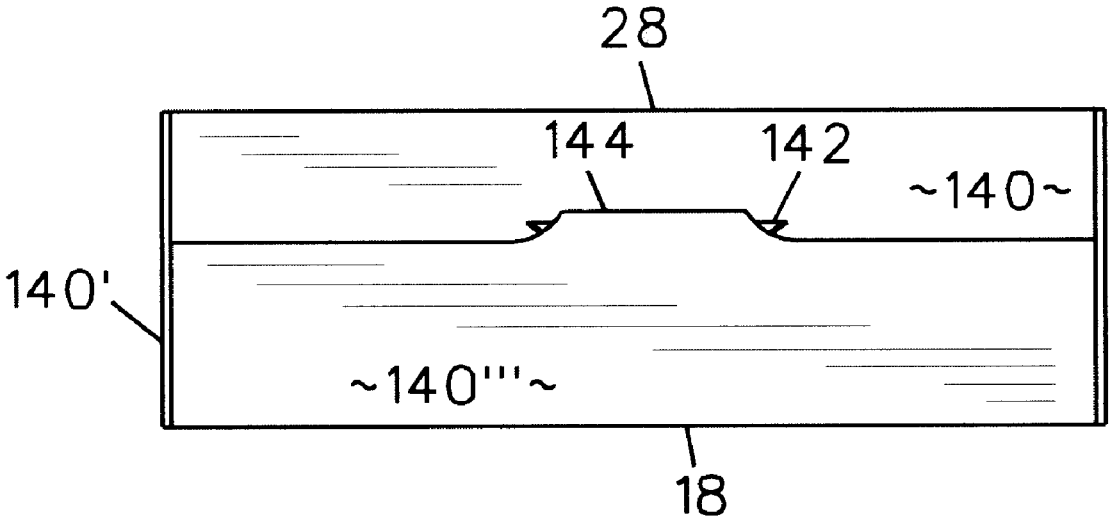
FIG. 6 is a bottom plan view of the container of FIG. 2.

Extending about this opening 500 is the spout assembly 300 in the open position as shown in FIG. 2.

To close opening 500 the front wall 310 of the spout assembly 300 is foldable about line 36. Upon folding, the gussets 360, 380 collapse about the fold lines 364, 384. Tab 332 is then inserted in the tab insert 232 which maintains the wall 310 in closure atop opening 500. To expose opening 500 tab 332 is removed with the panel 310 then being moved to its FIG. 2 position. Accordingly, spout 300 is presented for regulating the flow of the container contents from opening 500, the three walls 360, 310, 380 being about opening 500.

If the bottom of the container needs be open so as to dispense the contents in gross therefrom, the tab 144 is removed from the tab insert 142 so as to allow for the bottom panels 140, 140', 140", 140'" to be foldably swung away from their respective fold lines and overlying positions.

Accordingly, it can be seen that our blank 10 presents a spout assembly 300 integrally formed therein. Alternatively, gross dispensation of the contents from the bottom of the container is also allowed, the container being rigidified by the flaps/panels 140', 140", 230' therein.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A one-piece container blank comprising:

a front panel having first and second laterally spaced-apart vertical fold lines and lower and upper horizontal vertically spaced-apart horizontal fold lines extending between said vertical fold lines;

a first side panel foldably connected to said second vertical fold line of said front panel, said first side panel comprising:

a vertical fold line laterally spaced from said second vertical fold line of said front panel;

lower and upper vertically spaced-apart fold lines horizontally extending between said second vertical fold line of said front panel and said vertical fold line of said first side panel;

a top wall flap foldably connected to said upper fold line of said first side panel, said top wall flap presenting a first vertical free edge generally collinear with said vertical fold line of said first side panel;

a second vertical edge in said top wall flap laterally spaced from said first vertical edge of said top wall flap;

a slot in said top wall flap vertically spaced from said upper fold line of said first side panel and adjacent said second vertical edge in said top wall flap;

a lower wall flap foldably connected to said lower fold line of said first side panel, said lower flap presenting a slot therein;

an end wall glue flap foldably connected along said vertical fold line of said first side panel;

a second side panel foldably connected to said first vertical fold line of said front panel, said second side panel comprising:

a vertical fold line laterally spaced from said first vertical fold line of said front panel;

vertically spaced-apart lower and upper fold lines extending between said first vertical fold line of said front panel and said vertical fold line of said second side panel;

a lower wall flap foldably connected to said lower fold line of said second side panel, said lower wall flap assembly presenting a tab for insertion in said slot of said lower wall flap of said first side panel;

a top wall glue flap foldably connected along a portion of said upper fold line of said second side panel, said top wall glue flap presenting a first free vertical edge laterally spaced from said first vertical fold line of said front panel and a free horizontal edge vertically spaced from said upper fold line of said second side panel, said horizontal edge of said top wall glue flap spaced from said upper fold line of said second side panel at a distance to preclude interference with said slot in said top wall flap of said first side panel upon placement of said top wall flap of said first side panel atop said top wall glue flap of said second side panel, said free vertical edge of said top wall glue flap generally collinear with said second vertical edge of said top wall flap and spaced from said upper fold line of said front panel to present a top wall opening upon a folding of said blank;

an end wall panel foldably connected to said vertical fold line of said second side panel and designed to lie contiguous with said end wall glue flap upon a folding of said blank, said end wall panel comprising:

a vertical free edge laterally spaced from said vertical fold line of said second side panel;

a lower wall flap foldably connected to a lower fold line of said end wall panel, said lower fold line of said end panel generally collinear with said lower fold line of said second side panel;

a top wall flap foldably connected to an upper fold line of said end panel and designed to lie contiguous with said top wall glue flap upon a folding of said blank, said upper fold line of said end wall panel generally collinear with said upper fold line of said second side panel, a folding of said panels and said flaps along said respective fold lines and adhesion of said respective glue flaps against contiguous wall flaps presenting a generally rectangular container having said opening in a top wall thereof, said tab of said lower wall flap inserted in said slot releasably connecting said lower wall flaps of said first and second side panels;

a spout assembly about said top wall opening comprising:

a generally rectangular front spout panel foldably connected to said upper fold line of said front panel;

a tab extending from said front spout panel for insertion in said slot of said top wall flap of said first side panel upon said placement of said top wall flap atop said top wall glue flap;

a first collapsible wing panel extending between a top of said front spout panel of said spout assembly and a juncture between said second vertical edge of said top wall flap and said upper fold line of said first side panel;

a second collapsible wing panel spaced from said first wing panel and extending between a top of said front spout panel of said spout assembly and a juncture of said first free vertical edge of said top wall glue flap of said second panel and said upper fold line of said second side panel, a folding of said front spout panel of said spout assembly about said front panel upper fold line positioning said spout front panel atop said opening, said front spout panel folding enhanced by a collapse of said wing panels of said spout during said folding, an insertion of said tab of said front spout panel into said slot of said top wall flap releasably closing said top wall opening.

2. The blank as claimed in claim 1 wherein each of said wing panels are generally triangular in configuration.

3. The blank as claimed in claim 1 further comprising means in each wing panel for collapsing each panel upon said folding of said front spout panel about said front panel upper fold line from a first position generally coplanar with said front panel to a second position atop said top wall opening.

4. The blank as claimed in claim 3 wherein said collapsing means comprises a fold line in each wing panel.

* * * * *